US005418873A

United States Patent [19]

Eriksson

[11] Patent Number: 5,418,873

[45] Date of Patent: May 23, 1995

[54] ACTIVE ACOUSTIC ATTENUATION SYSTEM WITH INDIRECT ERROR SENSING

[75] Inventor: Larry J. Eriksson, Madison, Wis.

[73] Assignee: Digisonix, Inc., Middleton, Wis.

[21] Appl. No.: 118,877

[22] Filed: Sep. 9, 1993

[51] Int. Cl.[6] ..... G10K 11/16

[52] U.S. Cl. ..... 381/71

[58] Field of Search ..... 381/71, 96

[56] References Cited

U.S. PATENT DOCUMENTS

| | | | |
|---|---|---|---|
| 3,821,473 | 6/1974 | Mullins | 381/96 |
| 3,826,870 | 7/1974 | Wurm et al. | 381/71 |
| 4,473,906 | 9/1984 | Warnaka et al. | 381/71 |
| 4,677,676 | 6/1987 | Eriksson . | |
| 4,811,309 | 3/1989 | Eriksson et al. . | |
| 4,903,249 | 2/1990 | Hoops et al. . | |
| 5,044,464 | 9/1991 | Bremigan | 381/71 |
| 5,229,556 | 6/1993 | Geddes | 381/71 |

*Primary Examiner*—Forester W. Isen

*Attorney, Agent, or Firm*—Andrus, Sceales, Starke & Sawall

[57] ABSTRACT

An active attenuation system has indirect error sensing. The invention operates in systems which attenuate an acoustic wave after the acoustic wave has propagated through and exited from a waveguide. Indirect error sensing is done by sensing the primary acoustic wave which is being attenuated while it is propagating through the waveguide, measuring a canceling acoustic wave while it is propagating in another waveguide, and by combining the measurements to generate an error signal corresponding to the error after the primary and canceling acoustic waves have combined in free space. Thus error measurements can be made without having exposed error sensors.

34 Claims, 2 Drawing Sheets

ACTIVE ACOUSTIC ATTENUATION SYSTEM WITH INDIRECT ERROR SENSING

BACKGROUND OF THE INVENTION

The invention relates to active acoustic attenuation systems operating to attenuate an acoustic wave in free space after the acoustic wave has propagated through and exited from a waveguide. In particular, the invention relates to a system where the acoustic error in the free space is measured indirectly. The invention is useful in many acoustic applications, and is particularly useful for out-of-pipe noise cancellation in exhaust systems.

In general, active acoustic attenuation systems inject a canceling acoustic wave to destructively interfere with and cancel an input acoustic wave. In a sound attenuation system, it is typical to sense the input acoustic wave with an input microphone and the output acoustic wave with an error microphone. The input microphone supplies an input or feedforward signal to an electronic controller, and the error microphone supplies an error or feedback signal to the electronic controller. The electronic controller, in turn, supplies a correction signal to a loudspeaker that generates a canceling acoustic wave to destructively interfere with the input acoustic wave, such that the output acoustic wave at the error microphone is zero (or at least reduced).

In automobile exhaust systems, input acoustic waves are typically created by the engine, and are then propagated through an exhaust pipe which serves as a waveguide to guide the wave into free space behind the automobile. There are, in general, two types of exhaust noise cancellation systems: in-pipe cancellation systems and out-of-pipe cancellation systems. With in-pipe cancellation systems, the canceling acoustic wave is injected directly into the exhaust pipe so that the input acoustic wave is attenuated before it propagates into free space at the rear of the automobile.

In out-of-pipe cancellation systems, a canceling acoustic wave is generated by a loudspeaker, but the canceling acoustic wave is not injected into the exhaust pipe. Rather, the canceling acoustic wave is directed to an area adjacent to the end of the exhaust pipe so that the acoustic wave from the exhaust pipe can be canceled out-of-pipe or in free space. In such an out-of-pipe cancellation system, it is typical to use a separate pipe or duct to direct the canceling acoustic wave from the loudspeaker to the area adjacent the end of the exhaust pipe.

The primary advantage of out-of-pipe cancellation systems is that the loudspeaker is not in contact with exhaust gases. Exhaust gases can be very hot and dirty, and can lessen the performance of a loudspeaker quickly.

One problem with out-of-pipe cancellation systems is that error sensing is normally done using an error sensor located on the rear bumper of the automobile near the exhaust pipe. Placing the error microphone next to or in the free space at the rear of the automobile allows the error microphone to make error measurements after destructive interference has occurred. The problem is that an error sensor so located is especially susceptible to damage because it is exposed to dirt, snow, ice, etc., and also because it is a target for vandalism.

SUMMARY OF THE INVENTION

The present invention alleviates the above noted problems with exposed error sensors in out-of-pipe noise cancellation systems. It does this by measuring the error in free space indirectly. This is done in the present invention by measuring the primary acoustic wave being attenuated within the primary waveguide (e.g. measuring engine noise within the exhaust pipe), measuring a canceling acoustic wave within the secondary waveguide (e.g. measuring cancellation sound within the cancellation sound pipe), and by combining the measurements to generate an output signal corresponding to the error in free space.

An object of the invention is to provide an out-of-pipe noise cancellation system where an error microphone is not exposed, thus reducing the susceptibility of damage to the system.

Other objects of the invention are to do the same without reducing the effectiveness of attenuation, and without substantially increasing the cost of such a system.

While the invention is particularly well-suited for indirect error measurement in out-of-pipe noise cancellation systems, the invention is also well-suited for analogous situations involving other acoustic applications such as vibration control where the waveguides are mechanical structures (e.g. beams or plates).

DETAILED DESCRIPTION OF THE PREFERRED EMBODIMENTS

The drawings show out-of-pipe noise cancellation systems with indirect error sensing in accordance with the present invention. Indirect error sensing can be accomplished electrically using microphones 12 and 14 as acoustic sensors (see FIG. 1), or can be accomplished acoustically using acoustic probes 112 and 114 as acoustic sensors (see FIG. 2).

Figure 1:
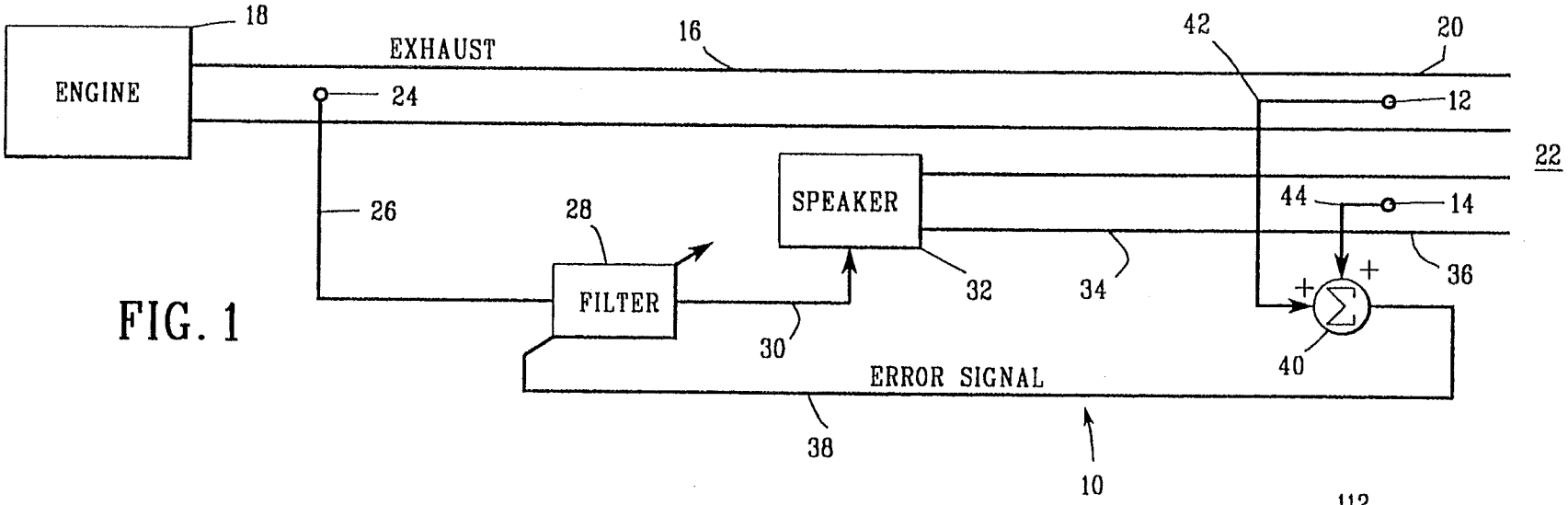
FIG. 1 is a schematic drawing of an out-of-pipe noise cancellation system in accordance with the present invention.

Referring to FIG. 1, an active acoustic attenuation system 10 generates a canceling acoustic wave that destructively interferes with engine noise exiting from an exhaust pipe 16. As depicted in FIG. 1, the noise is generated by an engine 18. The noise propagates down the exhaust pipe 16 as a longitudinal wave. The engine noise is referred to herein as the primary acoustic wave. The exhaust pipe 16 acts as a waveguide for propagating the primary acoustic wave (i.e. engine noise) from the engine 18 through an exit 20 into free space 22. The exhaust pipe 16 is referred to herein as the primary waveguide 16.

In an automobile exhaust system, the free space 22 is typically the open air space to the rear of the automobile. For the purposes of this invention, however, it is not necessary that the free space 22 be an open air space.

Rather, free space as used herein refers to areas where acoustic waves are not being propagated and guided through waveguides. As such, free space can occur in gases, liquids, solids, or any other medium in which acoustic waves can propagate. In contrast to free space, waveguides guide acoustic waves along one or more paths. In a sound cancellation system, a waveguide is typically a pipe or a duct. In a mechanical vibration system, a waveguide is typically a beam or some other mechanical structure guiding the vibrational waves.

The active attenuation system shown in FIG. 1 has an input microphone 24 for sensing the primary acoustic wave in the primary waveguide 16. The input microphone 24 generates an electrical input or feedforward signal in line 26. As an alternative, note that a signal from error microphone 12 can be used as the input signal in line 26 (not shown).

The electrical input signal in line 26 is transmitted to an adaptive filter 28. The preferred filter is an adaptive, recursive filter having a transfer function with both poles and zeros. Reference should be made to U.S. Pat. No. 4,677,676, which is incorporated herein, to facilitate understanding of the adaptive, recursive filter 28.

The filter 28 generates a correction signal in line 30 that is used to drive the acoustic actuator 32 (e.g. loudspeaker 32). The correction signal in line 30 is generated by filter 28 in such a manner that the loudspeaker 32 is driven to generate a canceling acoustic wave that will destructively interfere with the primary acoustic wave in the free space 22. After the canceling acoustic wave is generated by loudspeaker 32, it is guided by a secondary waveguide 34. The canceling wave propagates in the secondary waveguide 34 through an exit 36 into free space 22. The exit 36 of the secondary waveguide 34 is preferably in the vicinity of the exit 20 of the primary waveguide 16. Locating exits 20 and 36 near each other facilitates attenuation.

When generating correction signal 30, the filter 28 also receives an error or feedback signal in line 38. In the present invention, the error or feedback signal in line 38 is sensed indirectly. To sense the error indirectly, microphone 12 located in the primary waveguide 16 generates a primary wave signal in line 42, and microphone 14 located in the secondary waveguide 34 generates a secondary wave signal 44. The primary wave signal 42 and the secondary wave signal 44 are summed in summer 40 to produce an error or feedback signal in line 38. The primary wave signal in line 42 is an electrical signal representing the primary acoustic wave at the location of the microphone 12 in the primary waveguide 16. The secondary wave signal in line 44 is an electrical signal representing the canceling wave at the location of the microphone 14 in the secondary waveguide. The error signal in line 38 is an electrical signal that represents the combination of the primary and canceling acoustic waves, that is, it indirectly represents the error in free space. Thus, the error in free space 22 can be measured without having an error microphone exposed to the environment.

In an automobile out-of-pipe noise cancellation system, it is preferred that microphone 12 in the primary waveguide be located 6 to 12 inches before or upstream of the exit 20. This distance is sufficient to protect the microphone 12 from the outside environment and from vandalism. It is also preferred that the microphone 14 in the secondary waveguide be located before or upstream of the exit 36 in the secondary waveguide 34 at a distance that is essentially the same as the distance that microphone 12 in primary waveguide 16 is before the exit 20.

In a typical out-of-pipe cancellation system for an automobile, the primary waveguide 16 will be an exhaust pipe having a circular cross section and a 2 to 3 inch diameter. In such an application, it is likely that the primary acoustic wave will propagate in the plane wave mode only, and will not have transverse modal energy in higher order modes. Thus, one microphone across a transverse plane in the pipe 16 (such as microphone 12) should be sufficient to accurately sense the plane wave at the location of microphone 12. If the primary waveguide 16 has a large enough cross section (or the input noise includes very high frequencies), it may be useful to have more than one microphone in the transverse plane at the location of microphone 12 to more accurately characterize the primary wave at that location. Analogous considerations apply to microphone 14 in the secondary waveguide 34. That is, in an automobile out-of-pipe noise cancellation system, the secondary waveguide 34 is typically a pipe with a circular cross section having essentially the same diameter as the exhaust pipe 16. Since the primary acoustic wave propagating through the primary waveguide 16 is normally a plane wave, the canceling acoustic wave propagating through the secondary waveguide 34 will also normally be a plane wave. This is because the canceling acoustic wave is like, although opposite to, the primary acoustic wave; and, the secondary waveguide 34 has similar dimensions to the primary waveguide 16. In addition, more than one microphone 14 may be useful, if the canceling wave has energy in transverse higher order modes.

Figure 3:
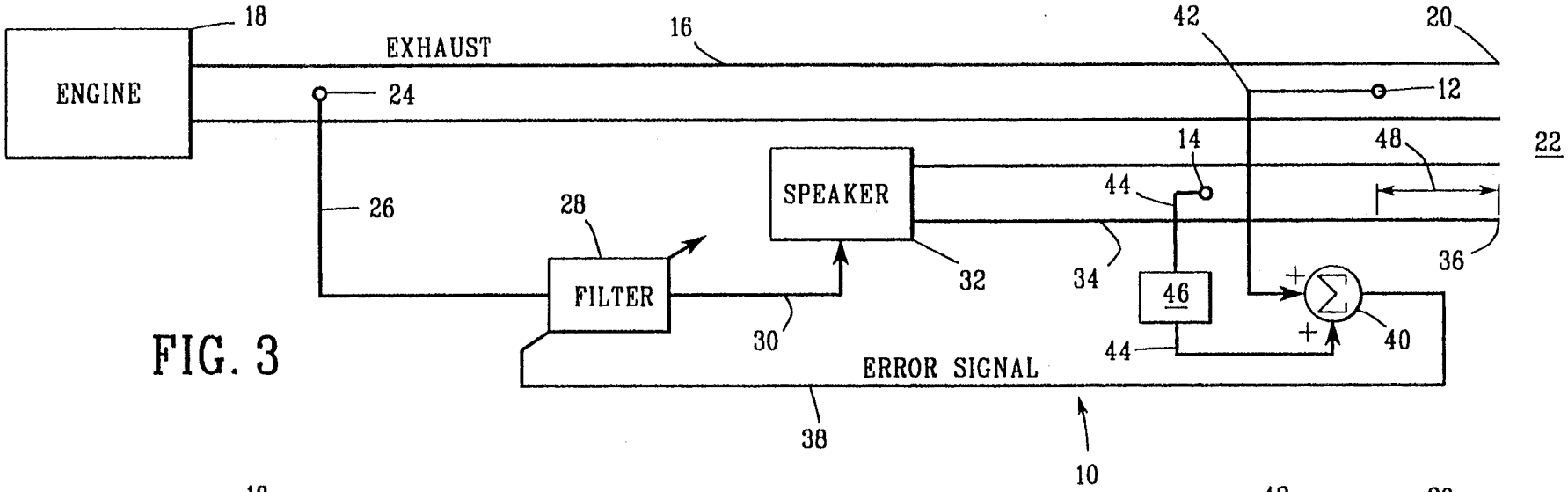
FIG. 3 is a drawing like FIG. 1 showing a compensating filter in accordance with a further embodiment of the invention.

Referring to FIG. 3, it is not necessary that the microphone 14 in the secondary waveguide be located before or upstream of exit 36 at a distance that is essentially the same as the distance that microphone 12 in the primary waveguide 16 is before exit 20. A compensating filter 46 can be used in line 44 to adjust (i.e. delay) the signal in line 44 so that the signal in line 44 being transmitted to summer 40 properly represents the canceling acoustic wave at a distance 48 before the exit 36. The distance 48 is essentially the same as the distance microphone 12 is located before exit 20 in the primary waveguide 16. Note that a compensating filter like filter 46 could alternatively be used in line 42 in a system where microphone 12 was further upstream from exit 20 than microphone 14 was before exit 36.

Figure 4:
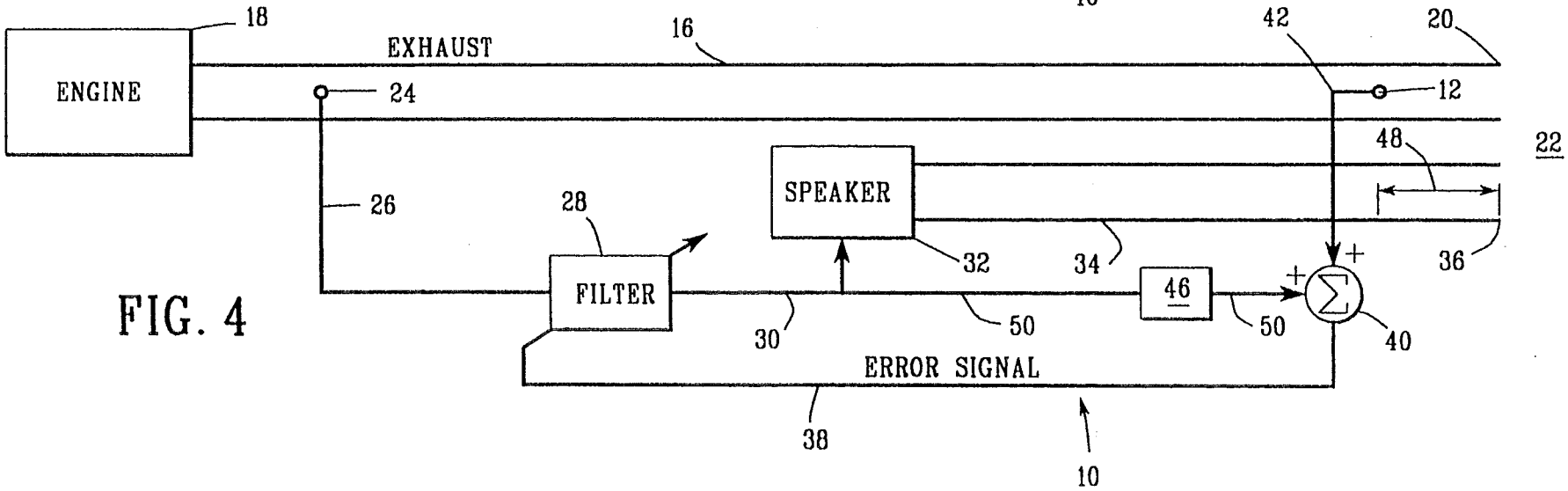
FIG. 4 is a drawing like FIG. 1 showing indirect error sensing without a sensor in the secondary waveguide.

FIG. 4 shows a system with indirect error sensing like FIG. 1 and FIG. 3, but without microphone 14 in the secondary waveguide 34. In FIG. 4, the correction signal 30 that drives the actuator 32 is also used to represent the canceling acoustic wave at the distance 48 before the exit 36. The correction signal 30 is transmitted in line 50 to the compensating filter 46. The compensating filter 46 adjusted (i.e. delays) the correction signal so that the signal in line 50 being transmitted to summer 40 properly represents the canceling acoustic wave generated by the speaker 32 at a distance 48 before the exit 36. The compensated signal in line 50 is summed with the signal in line 42 from microphone 12 by summer 40 to generate the error signal in line 38.

Figure 2:
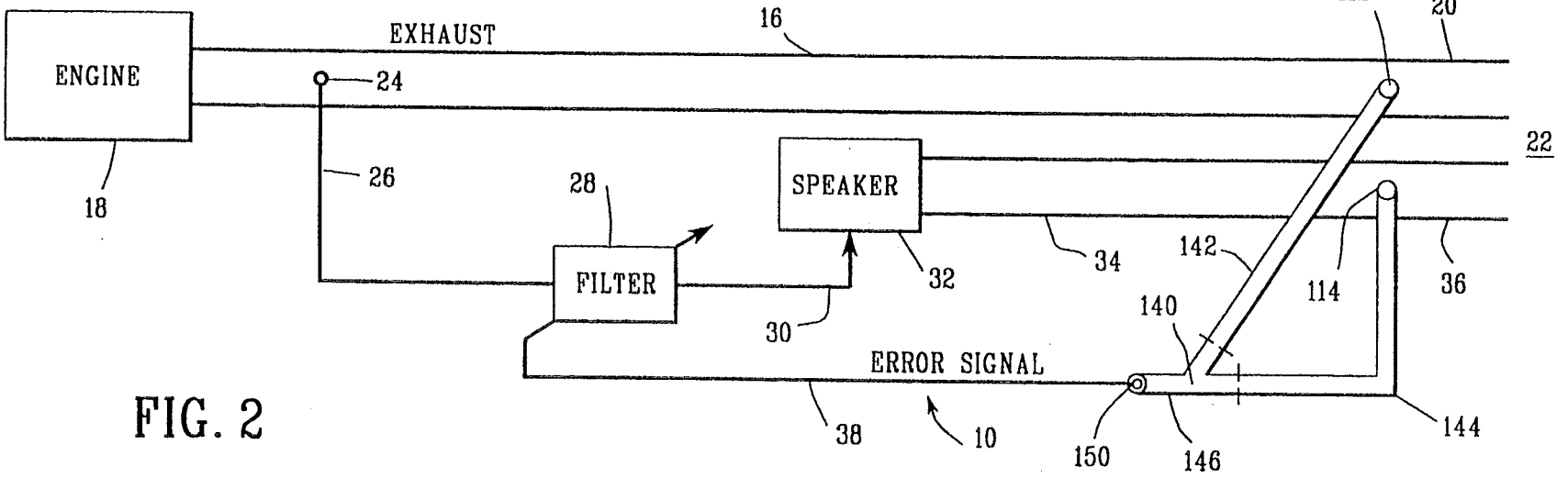
FIG. 2 is a schematic drawing of an out-of-pipe noise cancellation system in accordance with another embodiment of the present invention.

FIG. 2 shows another embodiment of the present invention in which the primary acoustic wave and the canceling acoustic wave are sensed using acoustic probes 112 and 114, respectively. The system 10 shown in FIG. 2 is similar to the system 10 shown in FIG. 1 in many respects, and like reference numbers are used where appropriate to facilitate understanding. In particular, the embodiment in FIG. 2 is similar to the embodiment in FIG. 1, except that the embodiment in FIG. 2 uses acoustic probes 112 and 114, acoustic fitting 140, and a microphone 150, to indirectly measure an error signal which is then transmitted to the filter 28 in line 38.

The acoustic probe 112 in the primary wave guide 16 senses the primary wave and transmits a signal acoustically along a tubular body 142 of the probe 112. Likewise, the probe 114 in the secondary wave guide senses the canceling acoustic wave and transmits a signal acoustically along the tubular body 144 of the probe 114. Both the tubular body 142 of probe 112 and the tubular body 144 of probe 114 are connected to an acoustic fitting 140. In the acoustic fitting 140, the acoustic signal representing the primary wave is combined with the acoustic signal representing the canceling wave to form an acoustic combination signal in portion 146 of the fitting 140. A microphone 150 is located in the portion 146 of the fitting 140, and senses the combination wave to generate an error signal in line 38.

U.S. Pat. Nos. 4,811,309 and 4,903,249 disclose an acoustic probe system with a microphone that is suitable for the embodiment shown in FIG. 2, and are incorporated by reference herein. (These patents also show microphone probes that may be appropriate for sensor 24, and the sensors in the embodiments shown in FIGS. 1, 3 and 4.) It is preferred that the bodies 142 and 144 of the probes have essentially the same characteristics, and essentially the same diameter and length.

In general, the system of the present invention is not only useful for sound attenuation in ducts, but also for attenuating any elastic wave propagating and exiting from a waveguide. Thus, the term acoustic wave as used herein includes any such elastic wave, and the term waveguide as used herein includes any structure for guiding an acoustic wave through an elastic medium, including solid, liquid or gas. For example, waveguides include ducts, impedance tubes, and vibration structures such as beams, plates, etc. An acoustic wave propagating through a waveguide is sensed with an acoustic sensor, such as a microphone or an acoustic probe in a sound system, or an accelerometer in vibrational applications, etc. An acoustic wave can be generated by an acoustic actuator, such as a loudspeaker in a sound system or a shaker in vibrational applications, etc.

It can also be appreciated that the invention is not limited to acoustic attenuation systems, but is useful for indirectly measuring any output acoustic wave that is the combination of a primary acoustic wave exiting from a primary waveguide and a secondary acoustic wave exiting from a secondary waveguide. It is not necessary that the output wave be in free space, rather the output wave can propagate in a waveguide.

It is recognized that various equivalents, alternatives, and modifications of the present invention are possible and should fall within the scope of the claims.

I claim:

1. A method for attenuating a primary acoustic wave wherein the primary acoustic wave propagates through and exits from a primary waveguide, the method comprising the steps of:

sensing the primary acoustic wave before the primary acoustic wave exits from the primary waveguide to generate a primary wave signal;

electrically generating a secondary acoustic wave;

propagating the secondary wave through a secondary waveguide;

allowing the secondary acoustic wave to exit the second waveguide;

sensing the secondary acoustic wave before the secondary acoustic wave exits from the secondary wave guide to generate a secondary wave signal; and combining the primary and secondary wave signals to generate an error signal corresponding to the output acoustic wave.

2. A method as recited in claim 1 wherein:

the primary and secondary wave signals are acoustic signals;

the primary and secondary acoustic wave signals are combined acoustically to generate an acoustic combination signal; and the acoustic combination signal is sensed to generate an electrical error signal.

3. A method as recited in claim 1 wherein the primary and secondary wave signals are electrical signals, and are combined to generate an electrical error signal.

4. A method as recited in claim 1 wherein the acoustic waves are sound waves and the waveguides are ducts.

5. A method as recited in claim 1 wherein the acoustic waves are mechanical vibrations, and the waveguides are mechanical structures.

6. A method as recited in claim 1 further comprising the step of delaying the secondary wave signal before combining the secondary wave signal with the primary wave signal.

7. A method as recited in claim 1 further comprising the step of delaying the primary wave signal before combining the primary wave signal with the secondary wave signal.

8. A method for attenuating a primary acoustic wave propagating through and exiting from a primary waveguide into free space, the method comprising the steps of:

sensing the primary acoustic wave in the primary waveguide before the primary acoustic wave exits the primary waveguide to generate a primary wave signal;

generating a canceling acoustic wave;

propagating the canceling acoustic wave through a secondary waveguide;

allowing the canceling acoustic wave to exit the secondary waveguide into free space so that the canceling acoustic wave can destructively interfere with the primary acoustic wave in free space;

sensing the canceling acoustic wave in the secondary waveguide before the canceling acoustic wave exits the secondary waveguide to generate a secondary wave signal;

combining the primary wave signal and the secondary wave signal to generate an error signal; and using the error signal to adaptively generate the canceling acoustic wave.

9. A method as recited in claim 8 further comprising the step of delaying the secondary wave signal before combining the secondary wave signal with the primary wave signal.

10. A method as recited in claim 8 further comprising the step of delaying the primary wave signal before combining the primary wave signal with the secondary wave signal.

11. A method as recited in claim 8 further comprising the steps of:

sensing the primary acoustic wave to generate a feedforward input signal at a position along the primary wave guide that is before the position in which the acoustic wave is sensed to generate the primary wave signal; and using the feedforward input signal to generate the canceling acoustic wave, in addition to using the error signal to generate the canceling acoustic wave.

12. A method as recited in claim 8 further comprising the step of using the primary wave signal as an input signal to generate the canceling acoustic wave, in addition to using the error signal to generate the canceling acoustic wave.

13. A method as recited in claim 12 further comprising the step of delaying the secondary wave signal before combining the secondary wave signal with the primary wave signal.

14. A method as recited in claim 12 further comprising the step of delaying the primary wave signal before combining the primary wave signal with the secondary wave signal.

15. A method as recited in claim 8 wherein the primary and secondary wave signals are acoustic signals that are combined acoustically to generate an acoustic combination signal, and the acoustic combination signal is sensed to generate an electrical error signal which is used to generate the canceling acoustic wave.

16. A method as recited in claim 8 wherein the primary and secondary wave signals are electrical signals that are combined to generate an electrical error signal which is used to generate the canceling acoustic wave.

17. A method as recited in claim 16 wherein the primary and secondary wave signals are combined by summing the signals.

18. A method as recited in claim 8, wherein the acoustic waves are sound waves and the waveguides are ducts.

19. A method as recited in claim 8 wherein the acoustic waves are mechanical vibration waves, and the waveguides are mechanical structures.

20. A system for attenuating a primary acoustic wave propagating through and exiting from a primary waveguide, the system comprising:

an acoustic actuator for generating a canceling acoustic wave;

a secondary waveguide for propagating the canceling acoustic wave;

a first acoustic sensor along the primary waveguide that senses the primary acoustic wave propagating through the primary waveguide and generates a primary wave signal in response thereto;

a second acoustic sensor along the secondary waveguide that senses the canceling acoustic wave and generates a secondary wave signal in response thereto;

means for combining the primary and secondary wave signals to generate an error signal; and a filter that receives the error signal and generates a correction signal to drive the acoustic actuator.

21. A system as recited in claim 20 further comprising a compensating filter to delay the secondary wave signal before the secondary wave signal is combined with the primary wave signal to generate the error signal.

22. A system as recited in claim 20 further comprising a compensating filter to delay the primary wave signal before the primary wave signal is combined with the secondary wave signal to generate the error signal.

23. A system as recited in claim 20 further comprising:

a third acoustic sensor along the primary waveguide located before said first acoustic sensor along the primary waveguide, said third acoustic sensor generating a feedforward input signal, wherein the filter receives the feedforward input signal, in addition to the error signal.

24. A system as recited in claim 20 wherein the filter receives the primary wave signal as a feedforward input signal, in addition to receiving the error signal.

25. A system as recited in claim 20 wherein:

the acoustic waves are sound waves;

the waveguides are ducts;

the acoustic actuator is a loudspeaker;

the acoustic sensors are microphones; and the means for combining the primary and secondary wave signals to generate an error signal is a summer.

26. A system as recited in claim 25 wherein the primary microphone is located in the primary duct at a longitudinal distance of 6 to 12 inches from the exit of the primary duct; and the secondary microphone is located in the secondary duct at a longitudinal distance of 6 to 12 inches from the exit of the secondary duct.

27. A system as recited in claim 20 wherein the filter is an adaptive, recursive filter having a transfer function with both poles and zeros.

28. A system as recited in claim 20 wherein:

the acoustic waves are sound waves;

the waveguides are ducts;

the acoustic actuator is a loudspeaker;

the acoustic sensors are acoustic probes that transmit the wave signals acoustically; and the means for combining the primary and secondary wave signals to generate an error signal includes, an acoustic fitting connected to the primary probe and the secondary probe, the acoustic fitting receiving the primary wave signal through the primary wave probe and receiving the secondary wave signal through the secondary wave probe and acoustically combining the wave signals to generate an acoustic combination signal, and a microphone for sensing the acoustic combination signal and generating an electrical output signal representing the output acoustic wave.

29. A system for attenuating a primary acoustic wave propagating through and exiting from a primary wave guide, the system comprising:

an adaptive filter that receives an error signal and generates a correction signal;

an acoustic actuator that generates a canceling acoustic wave in response to the correction signal;

a secondary waveguide through which the canceling acoustic wave propagates and exits therefrom, wherein the canceling acoustic wave can destructively interfere with the primary acoustic wave after the primary acoustic wave exits the primary waveguide and the canceling acoustic wave exits the secondary waveguide;

a first acoustic sensor along the primary waveguide that senses the primary acoustic wave propagating through the primary waveguide and generates a primary wave signal in response thereto;

a compensating filter that receives the correction signal and delays transmission of the correction signal;

and means for combining the primary wave signal and the delayed correction signal to generate said error signal which is received by the adaptive filter.

30. A system as recited in claim 29 further comprising:

a second acoustic sensor along the primary waveguide located before the first acoustic sensor along the primary waveguide, the second acoustic sensor generating a feedforward input signal, wherein the adaptive filter receives the feedforward input signal in addition to the error signal.

31. The system as recited in claim 29 wherein the adaptive filter receives the primary wave signal as a feedforward input signal, in addition to receiving the error signal.

32. A method for attenuating a primary acoustic wave propagating through and exiting from a primary waveguide, the method comprising the steps of:

sensing the primary acoustic wave and the primary waveguide before the primary acoustic wave exits the primary waveguide to generate a primary wave signal;

using an error signal to adaptively generate a correction signal;

generating a canceling acoustic wave in response to the correction signal;

propagating the canceling acoustic wave through a secondary waveguide;

allowing the canceling acoustic wave to exit the secondary waveguide into free space so that the canceling acoustic wave can destructively interfere with the primary acoustic wave after the primary acoustic wave exits the primary waveguide and the canceling acoustic wave exits the secondary waveguide; and combining the primary wave signal and the correction signal to generate the error signal, wherein the correction signal is delayed before the correction signal is combined with the primary wave signal.

33. A method as recited in claim 32 further comprising the steps of:

sensing the primary acoustic wave to generate a feedforward input signal at a position along the primary waveguide that is before the position in which the acoustic wave is sensed to generate the primary wave signal; and using the feedforward input signal to generate the correction signal, in addition to using the error signal to generate the correction signal.

34. A method as recited in claim 32 further comprising the step of using the primary wave signal as an input signal to generate the correction signal, in addition to using the error signal to generate the correction signal.

* * * * *